United States Patent [19]

Golia

[11] Patent Number: 4,998,964

[45] Date of Patent: Mar. 12, 1991

[54] COMPUTER CONTROLLED EMBROIDERY MACHINE FOR EMBROIDERING ON CURVED SURFACES AND ATTACHMENT THEREFOR

[75] Inventor: Kenneth R. Golia, North Haven, Conn.

[73] Assignee: Ultramatic Embroidery Machine Company, North Haven, Conn.

[21] Appl. No.: 495,742

[22] Filed: Mar. 16, 1990

[51] Int. Cl.[5] ..... D05B 21/00

[52] U.S. Cl. ..... 112/121.12; 112/103; 112/308; 112/318

[58] Field of Search ..... 112/102, 103, 121.12, 112/63, 121.24, 121.27, 2, 318, 322, 262.2, 121.15, 262.3, 309, 155, 308

[56] References Cited

U.S. PATENT DOCUMENTS

| | | | |
|---|---|---|---|
| 3,329,109 | 7/1967 | Portnoff et al. | 112/121.12 |
| 3,650,231 | 3/1972 | Tinari et al. | 112/121.15 X |
| 3,669,047 | 6/1972 | Hedegaard | 112/121.15 |
| 4,098,201 | 7/1978 | Adamski, Jr. et al. | 112/121.15 X |
| 4,444,135 | 4/1984 | Yanagi et al. | 112/121.12 |
| 4,503,788 | 3/1985 | Giannuzzi et al. | 112/121.12 |
| 4,503,790 | 3/1985 | Keeton | 112/121.27 |
| 4,506,611 | 3/1985 | Parker et al. | 112/63 X |
| 4,541,351 | 9/1985 | Horita et al. | 112/262.2 |
| 4,555,999 | 12/1985 | Conner | 112/121.27 |
| 4,577,573 | 3/1986 | Peloggio | 112/322 X |
| 4,590,877 | 5/1986 | Schwarzberger | 112/262.3 |
| 4,628,843 | 12/1986 | Tajima | 112/121.12 |
| 4,653,415 | 3/1987 | Tajima | 112/262.2 |
| 4,665,844 | 5/1987 | Shibata | 112/103 |
| 4,730,566 | 3/1988 | Brophy | 112/121.12 |

*Primary Examiner*—Peter Nerbun

[57] ABSTRACT

A detachable attachment for mounting on an embroidery machine with a computer controlled X-Y guidance system for the embroidery frame has a support which is mounted on the transverse rail, an axle having its axis in the Y-axis and an arcuate frame element rotatably supported thereon and provided with an aperture above the embroidery station. A drive motor on the support rotates the frame element in either direction of rotation, and a connection is provided to the computer control. A clamping element is releasably engaged on the frame element to clamp the workpiece thereon. In operation, the computer control moves the rail and the attachment in the Y-axis relative to the embroidery station, and the motor of the attachment effects rotation of the frame element about that axis.

19 Claims, 4 Drawing Sheets

COMPUTER CONTROLLED EMBROIDERY MACHINE FOR EMBROIDERING ON CURVED SURFACES AND ATTACHMENT THEREFOR

BACKGROUND OF THE INVENTION

The present invention relates to embroidery machines and, more particularly, to a removable attachment for automatic embroidery machines which will permit a flat bed machine to embroider curved surfaces.

Numerically and tape controlled embroidery machines are now widely employed for repeatedly embroidering the same pattern in workpieces and the bulk of machines move the frame containing the workpiece relative to a fixed embroidery station in a horizontal plane. Developments in rapidly programmable embroidery systems have enabled the use of automatic embroidery machines for relatively short runs and even single pieces.

Although the bulk of embroidering is performed on surfaces which are disposed in a horizontal plane, not infrequently it is desirable to embroider the workpiece which has a curved surface such as a hat, a hat brim, a sleeve, and other tubular articles. To do so, the work surface is desirably supported on an arcuate surface. Because the amount of work that requires such an arcuate surface is relatively small, it is desirable to have an attachment which will enable conversion of a flat bed machine to provide such an arcuate surface. Examples of such attachments for automatic machines having X-Y guidance systems are those found in Tajima U.S. Pat. Nos. 4,628,843, granted Dec. 16, 1986, and U.S. Pat. No. 4,653,415 granted Mar. 31, 1987; and in Shibata U.S. Pat. No. 4,665,844 granted May 19, 1987.

Although these attachments do permit such conversion, they have certain disadvantages in terms of optimum control of the rotation of the workpiece about the Y-axis, or stability of the positioning of the frame at the embroidery station, or cost and ease of fabrication, or ease of assembly and disassembly to the embroidery machine.

It is an object of the present invention to provide an X-Y guidance embroidery machine assembly utilizing a novel attachment for embroidering curved surfaces.

It is also such an object to provide such an assembly wherein the attachment may be readily assembled and removed and is stably positionable.

Another object is to provide such an attachment which may be fabricated relatively easily and economically and which is long lived in operation.

SUMMARY OF THE INVENTION

It has now been found that the foregoing and related objects and advantages may be readily attained in an embroidery machine with a machine base providing a bed and a head spaced thereabove with at least one needle reciprocatable therein relative to an aperture in the bed to define an embroidery station therebetween. The machine has an X-Y guidance system for moving an embroidery frame relative to the embroidery station and including a rail extending transversely of the base and embroidery station and providing means for moving the embroidery frame transversely of the embroidery station (x-axis), as well as means for moving the rail perpendicularly to the longitudinal axis of the rail (Y-axis). The machine also has computer control means for operating the X-Y guidance system and the needle to embroider material in the embroidery station.

Mounted in the machine is a removable attachment for supporting and embroidering an article with a surface which is arcuate in the X-axis, and it includes a support, and means releasably mounting the support o the transverse rail for movement therewith in the Y-axis. On the support is an axle on the support having its axis extending in the Y-axis in alignment with the embroidery station and below the bed. An arcuate frame element is rotatably supported on the axle, and it has an aperture therein above and aligned with the embroidery station. Drive means is mounted on the support for rotating the frame element in either direction of rotation, and connector means releasably connects the drive means to the computer control. The attachment also includes a clamping element releasably engaged with the frame element to releasably clamp a workpiece therebetween. As a result, the computer control is operative to move the rail and thereby the frame along the Y-axis relative to the embroidery station and to operate the drive means of the attachment to rotate the frame element about the axis of rotation to embroider a workpiece in accordance with a preselected pattern.

Preferably, the drive means includes a reversible motor, a gear driven by the motor, and a cooperating gear operatively connected to the frame element. The gears are meshing pinion gears, and desirably the cooperating gear is an arcuate gear surface on the frame element.

Usually, the frame element aperture is generally rectangular, and the clamping means includes a top element with a cooperating aperture therein and releasable clamping elements to engage the top and frame elements. Desirably, the releasable clamping elements comprise quickly releasable expansible elements on one of the top and frame elements and apertures in the other of the elements in which the clamping elements are engageable.

In the usual embroidery machine, the guidance system includes a pair of drive motors operable independently to effect movement of the rail under control of the computer control in the X and Y directions. The connector means cooperates with the computer control to limit operation of the motor which effects movement of the rail in the X-direction. Desirably, this limitation of operation maintains the shaft of the motor in a stall position against pressures tending to effect rotation thereof and thereby prevents displacement in the X-direction.

BRIEF DESCRIPTION OF THE INVENTION

DETAILED DESCRIPTION OF PREFERRED EMBODIMENT OF THE INVENTION

Figure 1:
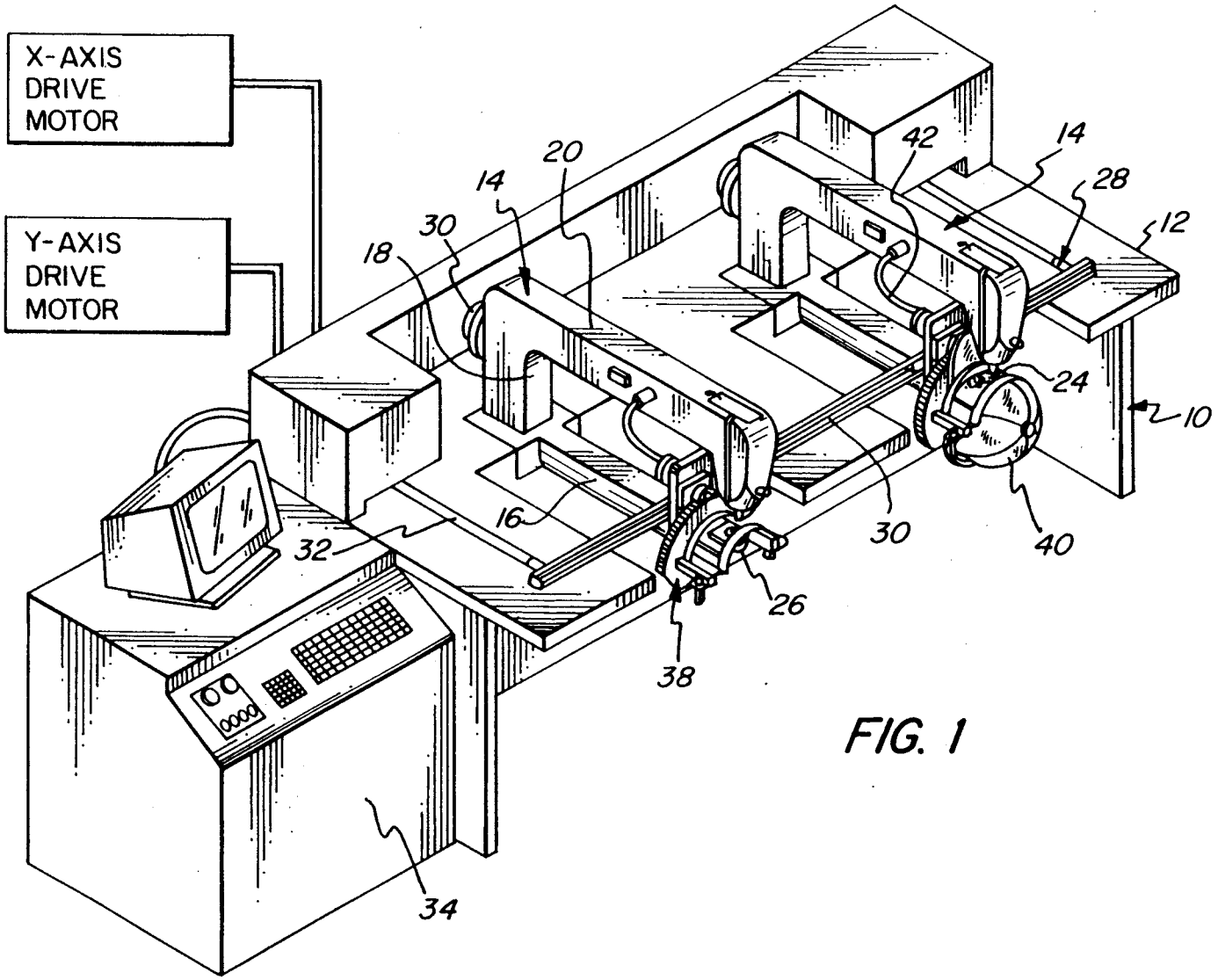
FIG. 1 is a perspective view of an X-Y guidance system embroidery machine embodying the attachments of the present invention with a cap clamped on the frame of one of the attachments and with the drive motors of the X-Y guidance system shown schematically.

Turning first to FIG. 1, therein illustrated is a computer controlled two head embroidery machine having a base 10 providing a horizontal table 12. A pair of embroidery machines generally designated by the numeral 14 is seated on the base 10, and these have a base arm 16, a neck 18, and a head 20. A drive motor 22 is provided at the rear of the machine 14 to reciprocate the needle 24 at the forward end of the head 20 relative to the bed 26 at the outer end of the base arm 16 and thereby define an embroidery station therebetween.

The embroidery machine has an X-Y guidance system generally designated by the numeral 28 which includes the transverse rail 30 on which the embroidery frame (not shown) may be moved in the transverse or X-direction, and the drive bars 32 which move the transverse rail 30 inwardly and outwardly (the Y-direction) relative to the embroidery station. The motors and gear mechanism for the guidance system 28 are illustrated schematically and are conventional. Also shown is the computer 34 which controls the movement of the needles 24 and of the guidance system 28. In normal operation of the machine, this effects motion of the frames (not shown) containing the cloth workpieces in both axes relative to the embroidery stations.

Over the beds 26 of each of the embroidery stations is an attachment of the present invention generally designated by the numeral 38, and on the right hand attachment as seen in FIG. 1 is clamped a cap 40. A cable connector 42 extends from the attachment 38 to the head 20 of the machine.

Figure 2:
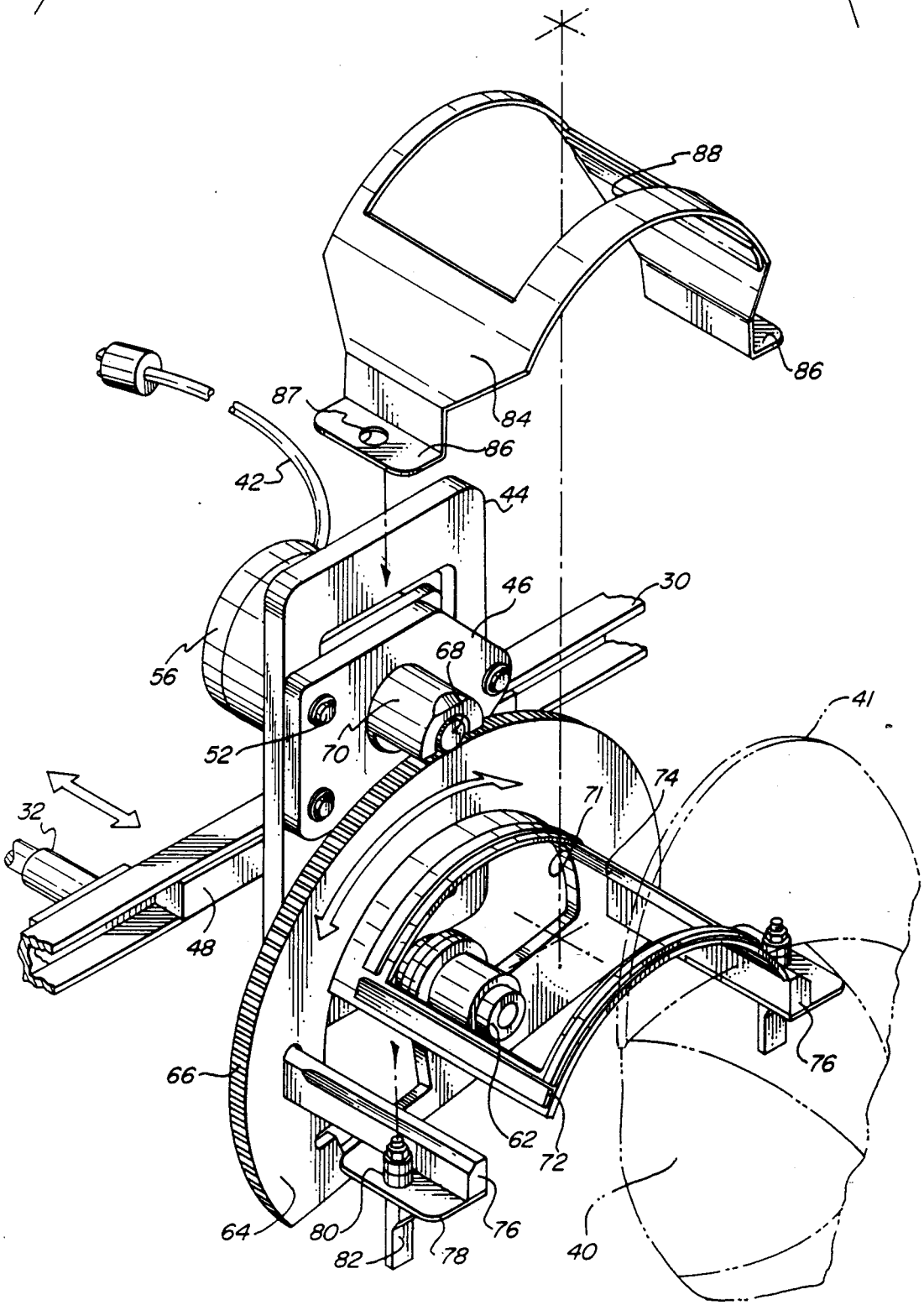
FIG. 2 is a partially exploded view of the attachment as mounted on the transverse rail and with the cap in phantom line.
Figure 3:
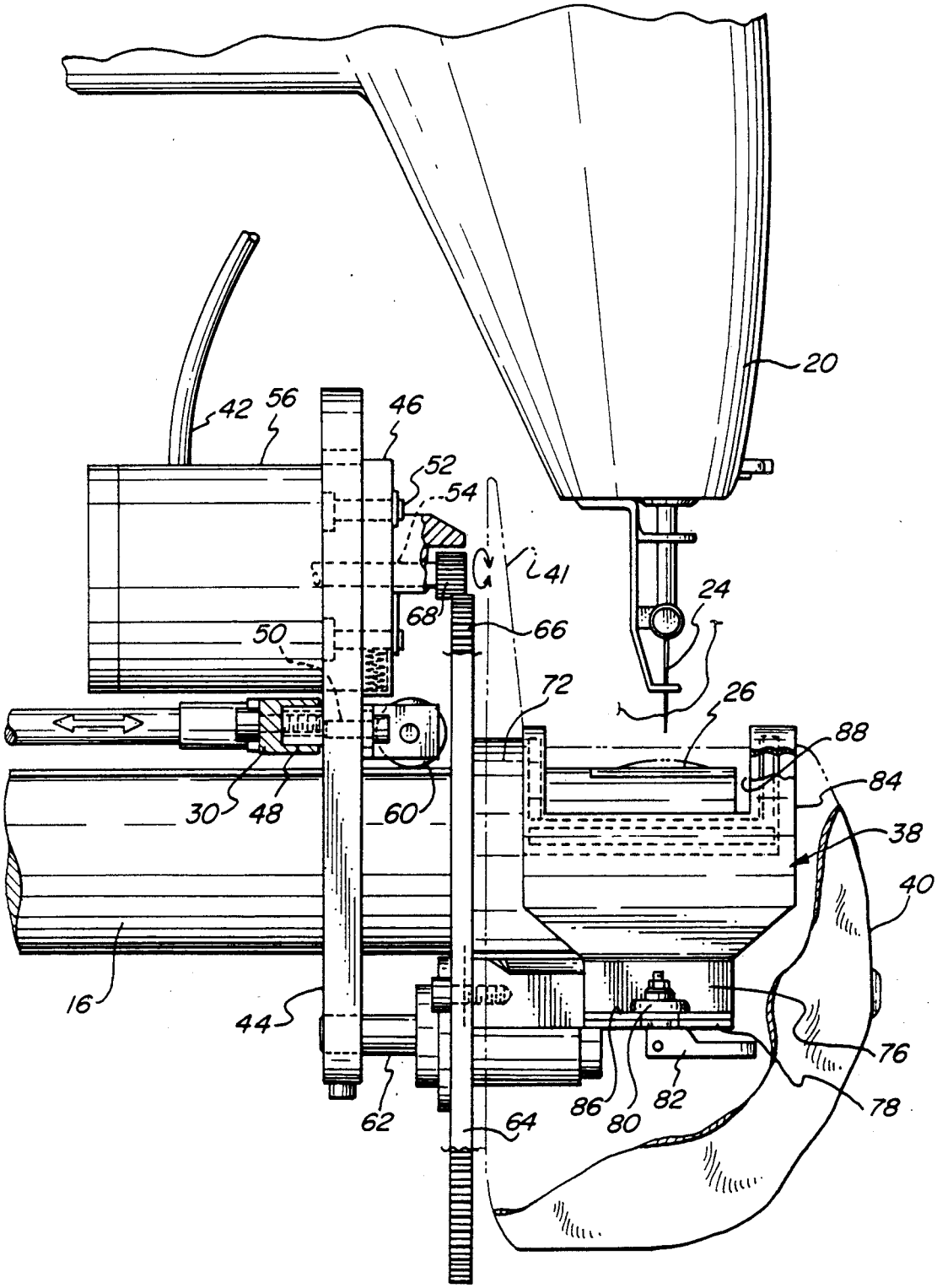
FIG. 3 is a fragmentary side elevational view of the machine at the embroidery station with the cap shown fragmentarily.
Figure 4:
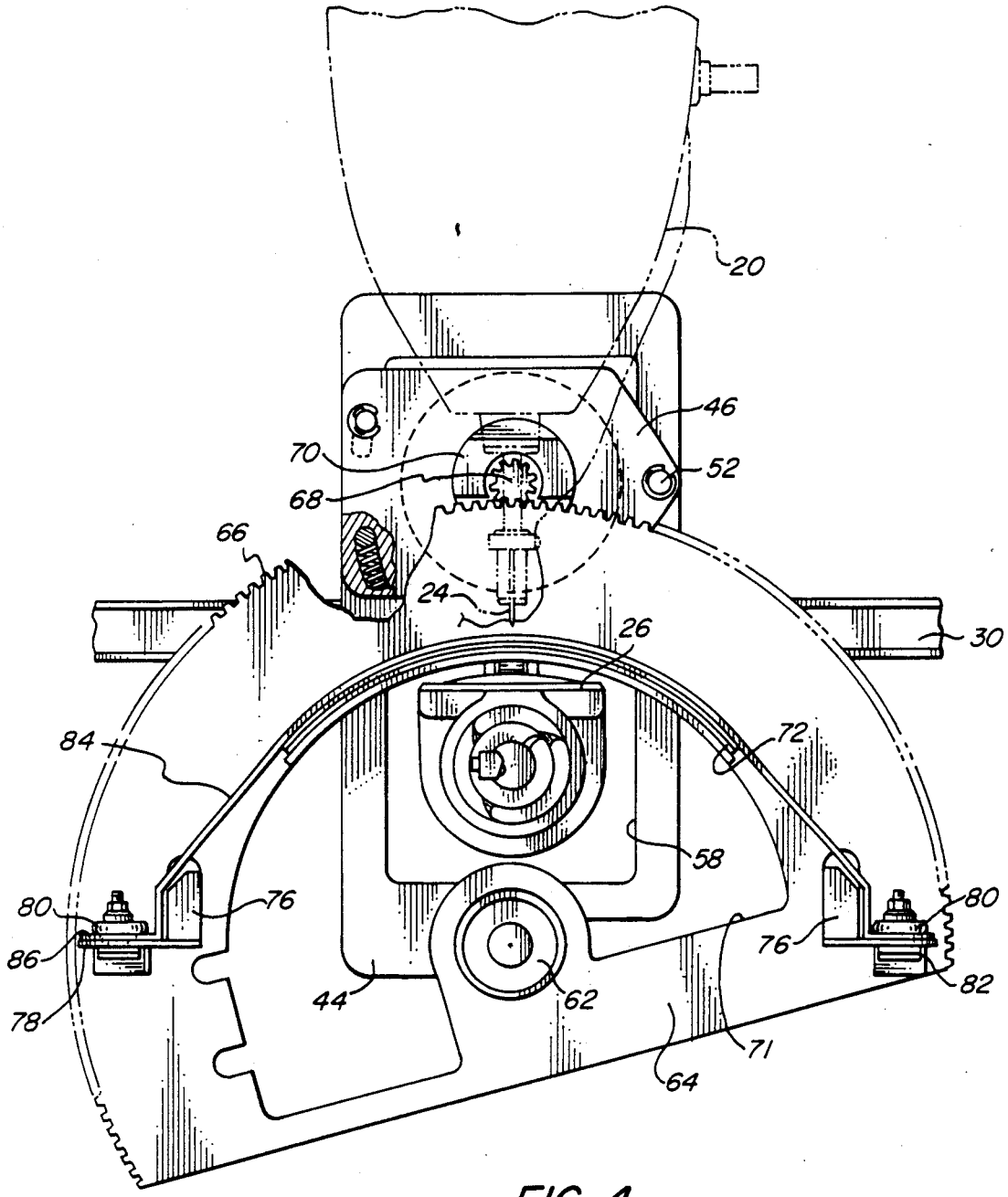
FIG. 4 is a fragmentary front elevational view of the station.

Turning now to FIGS. 2–4, the attachment 38 is illustrated in greater detail. A support assembly comprised of the large plate 44, small plate 46 and mounting bar 48 is secured to the transverse rail 30 by the fasteners 50 as seen in FIGS. 3. The plates 44, 46 are secured in assembly by the fasteners 52 seen best in FIG. 4 and have aligned apertures therein through which extends the drive shaft 54 of the motor 56 which is mounted to the rear surface of the large plate 44. As seen in FIG. 4, the large plate 44 also has a large aperture 58 through which the base arm 16 and its bed 26 extend. Mounted on the front surface of the large plate 44 is a roller 60 which rolls along the top surface of the arm 16 as will be described hereinafter.

On the lower portion of the large plate 44 below the aperture 58 is an axle 62 which extends below and parallel to the base arm 16 and rotatably supported therein is the large gear 64 which has an arcuate edge surface providing gear teeth 66 therealong. The drive shaft 54 of the motor 56 has a pinion gear 68 thereon which meshes with the teeth 66, and a protective cover 70 is provided thereover. The large gear 64 has an aperture 71 therein through which extends the base arm 16.

Projecting forwardly from the front face of the large pinch gear 64 is an arcuate frame element 72 which is radially spaced inwardly from the upper edge surface portion of the large gear 64 and which has a large rectangular aperture 74 therein. Extending forwardly from the front face of the large gear 64 below the frame element 72 are a pair of clamp supports 76 with side flanges 78 which support the expansible clamping elements 80 with the toggle arm 82 therebelow.

A generally arcuate clamp plate 84 has laterally extending flanges 86 at its lower ends with apertures 87 therein through which the expansible clamping elements 80 extend. The clamp plate 84 fits over the frame element 72 and has a large rectangular aperture 88 which is aligned with the apertures 74 of the frame element 72, and it clamps the cap 50 therebetween with the bill 41 projecting upwardly.

In use of the present invention, the frames (not shown) for the usual flat workpiece are removed from the transverse rail 30 at both embroidery stations and the attachments 38 are mounted thereby securing the mounting bars 48 thereon. The cable connectors 42 are plugged into the heads 20 which provides both power to the motor 56 and a connection to the computer 34. This connection signifies to the computer 34 that the attachments 38 are in place and that curved workpieces will be embroidered, causing the computer 34 to limit the power supplied to the motor (not shown) for the X-drive to be sufficient to maintain it in a stalled condition with the attachments 38 aligned with the beds 26. The clamp plates 84 are released by releasing one or both of the clamping elements 80 through pivoting of the toggle arms 82, and the workpieces 40 are placed on the frame elements 72 and clamped in place.

The computer 34 is provided with the desired instructions for the pattern to be embroidered, either by keyboard entry or by tape, and the keyboard of the computer is given the start command to supply power to the motors for the X-Y guidance system 28 and the motor 56 of the attachments 38 under computer control. This effects motion of the transverse rail 30 in the Y-direction and rotation of the frame elements 72 about the Y-axis as the needles 24 exit the workpiece 40. The stalled condition of the motor for the X-axis motion acts as a brake to hold the transverse rail position against transverse motion or displacement.

Upon completion of the pattern, the clamping elements 80 are released and the workpieces 40 are removed. If additional workpieces are to be embroidered, they are mounted and the start command again given until the project has been completed. When completed, the attachments 38 are removed from the rail 30 and the conventional frames replaced thereon.

As will be appreciated, the heads may have multiple needles cooperating with the beds as is conventional with multiple color or color change embroidery machines. The particular mounting used to affix the mounting plate to the transverse rail may vary with the nature of the rail configuration as will be readily appreciated by those with ordinary skill in the art.

In the illustrated embodiment, the machine has been shown with two heads. However, the present invention may be employed with single head machines and machines with 6,8 and more heads.

The clamp plate is desirably a relatively flexible formed metal piece to adapt to variations in thickness and contour of the workpieces. The releasable clamping elements illustrated are latches of the type sold by Southco, Inc. of Concordville, Pa. since they are engaged and released quickly by action of the toggles to expand or contract the portion projecting above the clamp plate, but other suitable fastening units may be substituted.

As is readily apparent, the attachment of the present invention is readily coupled to the X-Y guidance system to make use of the Y-axis motion and stabilize its positioning in the X-axis. The separate motor with the precision drive provided by the small and large gears enables precise rotation of the workpiece about the Y-axis.

Thus, it can be seen from the foregoing detailed specification and attached drawings that the present invention provides a unique, relatively simple but highly effective assembly for embroidering curved surfaces. The attachment may be fabricated relatively simple and economically to provide a long lived structure, and it may be quickly attached to and removed from the embroidery machine.

Having thus described the invention, what is claimed is:

1. In an embroidery machine, the combination comprising:

(a) a machine base providing a bed and a head spaced thereabove with at least one needle reciprocatable therein relative to an aperture in said bed, said needle and aperture defining an embroidery station therebetween;

(b) an X-Y guidance system for moving an embroidery frame relative to said embroidery station and including a rail extending transversely of said base and embroidery station and providing drive means for moving an embroidery frame transversely of said station along an X-axis, said system including drive means for moving said rail perpendicularly to its longitudinal axis along a Y-axis;

(c) computer control means for operating said X-Y guidance system and said needle;

(d) a removable attachment for supporting and embroidering an article with a surface which is convexly arcuate in the direction of said X-axis, said attachment including;

(i) a support;

(ii) means releasably mounting said support on said transverse rail for movement therewith in said Y-axis;

(iii) an axis on said support having its axis extending in said Y-axis in alignment with said embroidery station and below said bed;

(iv) an arcuate frame element rotatably supported on said axle and having an aperture therein above and aligned with said embroidery station;

(v) drive means on said support for rotating said frame element in either direction of rotation and including a reversible motor operable independently of said drive means of said X-Y guidance system;

(vi) connector means releasably connecting said motor of said drive means of said attachment to said computer control; and (vii) a clamping element releasably engaged with said frame element to releasably clamp a workpiece therebetween, whereby said computer control is operative to move said rail and thereby said frame along the Y-axis relative to said embroidery station and to operate said motor means of said attachment to rotate said frame element about said axis of rotation to embroider a workpiece in accordance with a preselected pattern.

2. The embroidery machine in accordance with claim 1 wherein said drive means of said attachment includes a gear driven by said motor, and a cooperating gear operatively connected to said frame element.

3. The embroidery machine in accordance with claim 2 wherein said gears are intermeshed pinion gears.

4. The embroidery machine in accordance with claim 3 wherein said cooperating gear is an arcuate gear surface on said frame element.

5. The embroidery machine in accordance with claim 1 wherein said frame element aperture is generally rectangular.

6. The embroidery machine in accordance with claim 1 wherein said clamping means includes a top element with a cooperating aperture therein, and releasable clamping elements to engage said top and frame elements.

7. The embroidery machine in accordance with claim 6 wherein said releasable clamping elements comprise quickly releasable expansible elements on one of said top and frame elements and cooperating apertures in the other of said elements in which said clamping elements are engageable.

8. The embroidery machine in accordance with claim 1 wherein said guidance system includes a pair of drive motors providing said drive means and operable independently to effect movement of said rail under control of said computer control in said X and Y directions.

9. The embroidery machine in accordance with claim 1 wherein said connector means cooperates with said computer a control to limit operation of the motor drive means which effects movement of said rail in the X-axis.

10. The embroidery machine in accordance with claim 9 wherein said limitation of operation maintains the shaft of said motor in a stall position against pressures tending to effect rotation thereof.

11. A removable attachment for an embroidery machine having a base with a bed and a head spaced thereabove to define an embroidery station, an X-Y guidance system for moving a frame relative to the embroidery station and including a transversely extending rail for supporting an embroidery machine frame, drive means for moving the frame in X and Y axes, and a computer control for operating the guidance system, said attachment being adapted to support and embroider an article with a surface which is convexly arcuate in the X direction extending transversely of said base, said attachment including;

(a) a support;

(b) means for releasably mounting said support on said transverse rail for movement therewith in a direction perpendicular to the longitudinal axis of the rail;

(c) an axle on said support having its axis extending perpendicularly to the longitudinal axis of the associated rail below and in alignment with the associated embroidery station;

(d) an arcuate frame element rotatably supported on said axle and having an aperture therein adapted to be disposed above and in alignment with the associated embroidery station;

(e) drive means on said support for rotating said frame element in either direction of rotation and including a reversible motor operable independently of said drive means of the X-Y guidance system;

(f) connector means for releasably connecting said motor of said drive means of said attachment to the computer control of the associated embroidery machine; and (g) a clamping element releasably engaged with said frame element to releasably clamp a workpiece therebetween, whereby the computer control may be operative to move the associated rail and thereby said frame in the perpendicular direction relative to the embroidery station and to operate said drive means of said attachment to rotate said frame element about said axis of rotation to embroider a workpiece in accordance with a preselected pattern.

12. The removable attachment in accordance with claim 11 wherein said drive means includes a gear driven by said motor of said drive means, and a cooperating gear operatively connected to said frame element.

13. The removable attachment in accordance with claim 12 wherein said gears are intermeshed pinion gears.

14. The removable attachment in accordance with claim 13 wherein said cooperating gear is an arcuate gear surface on said frame element.

15. The removable attachment in accordance with claim 11 wherein said frame element aperture is generally rectangular.

16. The removable attachment in accordance with claim 11 wherein said clamping means includes a top element with a cooperating aperture therein, and releasable clamping elements to engage said top and frame elements.

17. The removable attachment in accordance with claim 16 wherein said releasable clamping elements comprise quickly releasable expansible elements on one of said top and frame elements and cooperating apertures in the other of said elements in which said clamping elements are engageable.

18. The removable attachment in accordance with claim 11 wherein said connector means is adapted to cooperate with the computer control to limit operation of the motor which effects movement of the rail along its axis.

19. The removable attachment in accordance with claim 18 wherein said limitation of operation maintains the shaft of said motor in a stall position against pressures tending to effect rotation thereof.

* * * * *

UNITED STATES PATENT AND TRADEMARK OFFICE

CERTIFICATE OF CORRECTION

PATENT NO. : 4,998,964

DATED : March 12, 1991

INVENTOR(S) : Kenneth R. Golia

It is certified that error appears in the above-identified patent and that said Letters Patent is hereby corrected as shown below:

Column 5, line 36, please delete "axis" (first occurrence) and insert --axle--.

Column 8, line 13, after "its", please insert -- X- --.

Signed and Sealed this

Twentieth Day of October, 1992

*Attest:*

DOUGLAS B. COMER

*Attesting Officer*

*Acting Commissioner of Patents and Trademarks*